US009462371B2

(12) United States Patent
Li et al.

(10) Patent No.: US 9,462,371 B2
(45) Date of Patent: Oct. 4, 2016

(54) EARPHONE AND IMPLEMENTATION METHOD OF VIBRATILE EARPHONE

(71) Applicant: Goertek Inc., Weifang, ShanDong Province (CN)

(72) Inventors: Ke Li, Weifang (CN); Guangzhi Shao, Weifang (CN); Xiaodong Li, Weifang (CN); Long Yuan, Weifang (CN)

(73) Assignee: Goertek, Inc., Weifang, Shandong Province (CN)

( * ) Notice: Subject to any disclaimer, the term of this patent is extended or adjusted under 35 U.S.C. 154(b) by 0 days.

(21) Appl. No.: 14/433,415

(22) PCT Filed: Oct. 11, 2013

(86) PCT No.: PCT/CN2013/085055
§ 371 (c)(1),
(2) Date: Apr. 3, 2015

(87) PCT Pub. No.: WO2014/056448
PCT Pub. Date: Apr. 17, 2014

(65) Prior Publication Data

US 2015/0264470 A1 Sep. 17, 2015

(30) Foreign Application Priority Data

Oct. 12, 2012 (CN) ..... 2012 1 0387187

(51) Int. Cl.
*H04R 25/00* (2006.01)
*H04R 1/10* (2006.01)

(52) U.S. Cl.
CPC ..... *H04R 1/1091* (2013.01); *H04R 1/1008* (2013.01)

(58) Field of Classification Search
CPC H04R 1/1008; H04R 1/1016; H04R 1/1033; H04R 1/1058; H04R 1/1066; H04R 1/1075; H04R 5/033; H04R 5/0335; H04R 25/652; H04R 2201/023; H04R 2201/107; H04R 2420/07
USPC ..... 381/370, 371, 374, 376, 380
See application file for complete search history.

(56) References Cited

U.S. PATENT DOCUMENTS

2008/0240484 A1* 10/2008 Tanghe ..... H04R 3/14 381/370

FOREIGN PATENT DOCUMENTS

| | | |
|---|---|---|
| CN | 1128482 | 8/1996 |
| CN | 2922354 | 7/2007 |
| CN | 102892057 | 1/2013 |
| CN | 202949537 | 5/2013 |
| JP | 2009290474 | 12/2009 |

OTHER PUBLICATIONS

Machine Translation of Hosoda et al. Japanese Publication No. 2009-177574, Jun. 8, 2009.*

* cited by examiner

*Primary Examiner* — Brian Ensey
(74) *Attorney, Agent, or Firm* — Boyle Fredrickson, S.C.

(57) ABSTRACT

The present invention provides an earphone and an implementation method of vibratile earphone. The earphone comprises: a low-frequency detection control circuit and a vibratile terminal connected to the low-frequency detection control circuit; the low-frequency detection control circuit is for sending a control signal to the vibratile terminal when detecting a signal of low-frequency below a specified frequency from earphone signals; the vibratile terminal produces vibration when receiving the control signal sent from the low-frequency detection control circuit. The solution of the invention can make the earphone produce vibration when the earphone signals contain low frequency signals and thus improve people's sense of shock when they are listening to voices or playing games with the earphone.

5 Claims, 3 Drawing Sheets

EARPHONE AND IMPLEMENTATION METHOD OF VIBRATILE EARPHONE

TECHNICAL FIELD

The invention relates to the technical field of earphone system, and particularly relates to an earphone and an implementation method of vibratile earphone.

BACKGROUND ART

Earphones are finding wider and wider application in people's daily life. For example, people wear earphones when they are listening to music or playing electronic games.

However, the existing earphones are only able to output sound. Therefore, the inventor of this application intends to invent an earphone that can vibrate in specific sound scenarios, so as to improve people's sense of shock in scenarios such as listening to music or playing electronic games with the earphone.

SUMMARY OF THE INVENTION

The present invention provides an earphone and an implementation method of vibratile earphone, such that the earphone can produce vibration when earphone signals contain low frequency signals and thus improve people's sense of shock when they are listening to voices or playing games with the earphone.

The technical solution of the invention for achieving the above purpose is carried out as follows:

The invention discloses an earphone, comprising: a low-frequency detection control circuit and a vibratile terminal connected to the low-frequency detection control circuit;

the low-frequency detection control circuit is for sending a control signal to the vibratile terminal when detecting a signal of low-frequency below a specified frequency from earphone signals;

the vibratile terminal produces vibration when receiving the control signal sent from the low-frequency detection control circuit.

The earphone is a headset, and further comprises: a headband, two speaker shells and two speaker chambers; wherein the two speaker shells are connected with the two ends of the headband respectively, and the two speaker chambers are fixed on the two speaker shells respectively;

two low-frequency detection control circuits and correspond to two vibratile terminals respectively.

In the earphone, the two low-frequency detection control circuits are in the two speaker chambers respectively.

In the earphone, the two vibratile terminals are fixed on the parts, close to the headband, of the two speaker shells respectively, and the vibration of the two vibratile terminals causes the headband and the two speaker shells to vibrate.

In the earphone, each of the two speaker shells is provided with a vibration guiding column for transmitting the vibration produced by the vibratile terminal to the corresponding speaker chamber;

each of the vibration guiding columns extends into the corresponding speaker chamber, and the distal end of each of the vibration guiding columns is in contact with the inner wall of the corresponding speaker chamber.

The earphone further comprises: two vibration gum covers, which correspond to the two vibration guiding columns on the two speaker shells respectively;

the distal end of each of the vibration guiding columns is in contact with the inner wall of the corresponding speaker chamber via the corresponding vibration gum cover.

This invention also discloses an implementation method of vibratile earphone, comprising the following steps:

adding a low-frequency detection control circuit and a vibratile terminal into the earphone;

the low-frequency detection control circuit sending a control signal to the vibratile terminal when detecting a signal of low-frequency below a specified frequency from earphone signals; and the vibratile terminal producing vibration when receiving the control signal sent from the low-frequency detection control circuits.

In this method, the step of adding a low-frequency detection control circuit and a vibratile terminal into the earphone comprises:

adding a low-frequency detection control circuit into each of the two of the left and right speaker chambers of a headset; wherein the headset comprises a headband, two speaker shells and two speaker chambers, the two speaker shells are connected with the two ends of the headband respectively, and the two speaker chambers are fixed on the two speaker shells respectively; and fixing two vibratile terminals on the parts, close to the headband, of the two speaker shells of the headset respectively, the vibration of the two vibratile terminals causes the headband and the two speaker shells to vibrate.

This method further comprises:

providing a vibration guiding column on each of the two speaker shells of the headset for transmitting the vibration produced by the vibratile terminals to the corresponding speaker chambers;

extending each of the vibration guiding columns into the corresponding speaker chamber, such that the distal end of each of the vibration guiding columns is in contact with the inner wall of the corresponding speaker chamber.

This method further comprises:

providing a vibration gum cover between the corresponding vibration guiding column and speaker chamber, such that the vibration guiding column is in contact with the corresponding speaker chamber via the vibration gum cover.

From the above description, it can be seen that this kind of earphone of the invention comprises: a low-frequency detection control circuit and a vibratile terminal connected to the low-frequency detection control circuit, wherein the low-frequency detection control circuit sends a control signal to the vibratile terminal when detecting a signal of low-frequency below a specified frequency from earphone signals, the vibratile terminal produces vibration when receiving the control signal sent from the low-frequency detection control circuit. This technical solution makes the earphone produce vibration when sound signals contain low-frequency parts, which improves people's sense of shock when they are listening to voice or playing games with the earphone.

DETAILED DESCRIPTION OF THE INVENTION

In this invention, the earphone comprises: a low-frequency detection control circuit and a vibratile terminal connected to the low-frequency detection control circuit; the low-frequency detection control circuit is for sending a control signal to the vibratile terminals when detecting a signal of low-frequency below a specified frequency from earphone signals; the vibratile terminal produces vibration when receiving the control signal sent from the low-frequency detection control circuit. This makes the vibratile terminal vibrate when the earphone outputs bass notes, which also causes the earphone to vibrate.

The earphone may be an earplug phone (also referred to as in-ear phone) or a headset. However, since the earphone will produce vibration, an in-ear phone may drop from ears. Therefore, the solution of low frequency vibration is optimally implemented in a headset.

To make the object, technical solution and advantages of the present invention clearer, an embodiment of the present invention will be hereinafter described in further detail with reference to the drawings.

Figure 1:
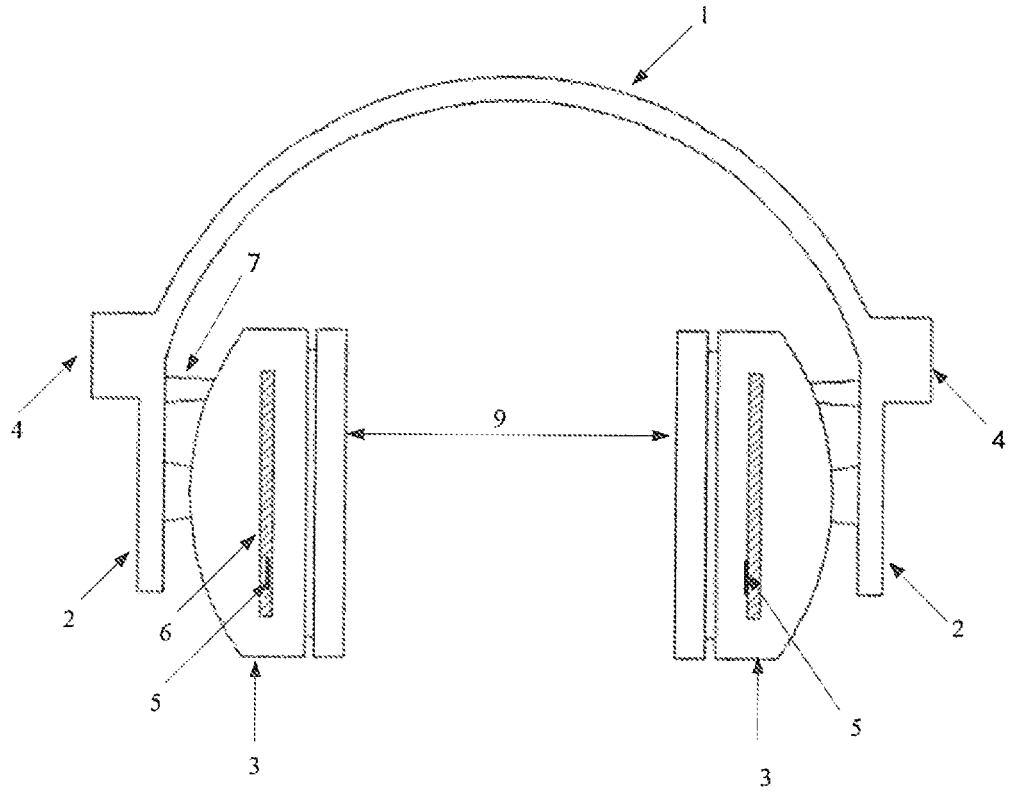
FIG. 1 is a structural diagram of a headset according to an embodiment of the present invention.

FIG. 1 is a structural diagram of a headset according to an embodiment of the present invention. As shown in FIG. 1, the headset comprises: a headband 1, two speaker shells 2 and two speaker chambers 3, wherein the two speaker shells 2 are connected with the two ends of the headband 1 respectively, and the two speaker chambers 3 are fixed on the two speaker shells 2 respectively.

Further, the headset shown in FIG. 1 also comprises two vibratile terminals 4, and a speaker (not shown in FIG. 1), a board 6 and a chip 5 are provided in each of the speaker chambers 3. The two speaker chambers 3 are covered with cushions 9 so as to make the user's ears more comfortable when in contact with the earphones.

The chips 5 comprise detection circuits for sending a signal to the control circuits on the boards 6 when detecting a signal of low-frequency below a specified frequency from earphone signals. The control circuits on the boards send a control signal to the two vibratile terminals 4 when receiving the signals sent from the detection circuits, and thus control the two vibratile terminals to produce vibration. In which, the vibratile terminal is connected to the control circuit on the board via wires (the wires are not shown in FIG. 1). The detection circuit in the chip 5 and the control circuit on the board together constitute the low-frequency detection control circuit mentioned above. It can be seen in FIG. 1 that two low-frequency detection control circuits correspond to two vibratile terminals respectively. That is to say, each of the left and right parts of the headset is provided with a vibratile terminal and a low-frequency detection control circuit.

Since the boards 6 and the chips 5 are located in the speaker chambers 3, the low-frequency detection control circuits are in the speaker chambers.

As shown in FIG. 1, the two vibratile terminals 4 are fixed on the parts, close to the headband 1, of the two speaker shells 2 respectively, which can be specifically fixed by screws. The vibration of the two vibratile terminals 4 causes the headband 1 and the two speaker shells 2 to vibrate together. In this way, the vibration produced by the vibratile terminals is transmitted to the user's head through the headband, which makes the user's head feel the vibration.

As shown in FIG. 1, each of the two speaker shells 2 of the headset is provided with a vibration guiding column 7 for transmitting the vibration produced by the corresponding vibratile terminal 4 to the corresponding speaker chamber 3.

Figure 2:
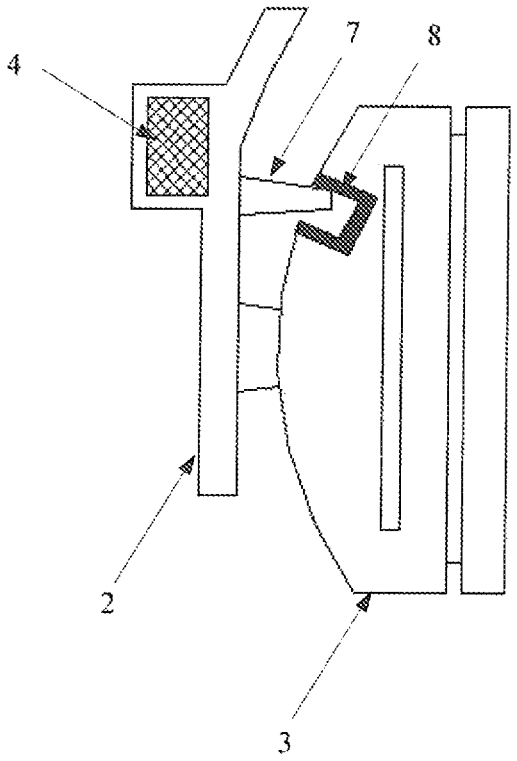
FIG. 2 is a sectional diagram of part of an earphone shown in FIG. 1.
Figure 3:
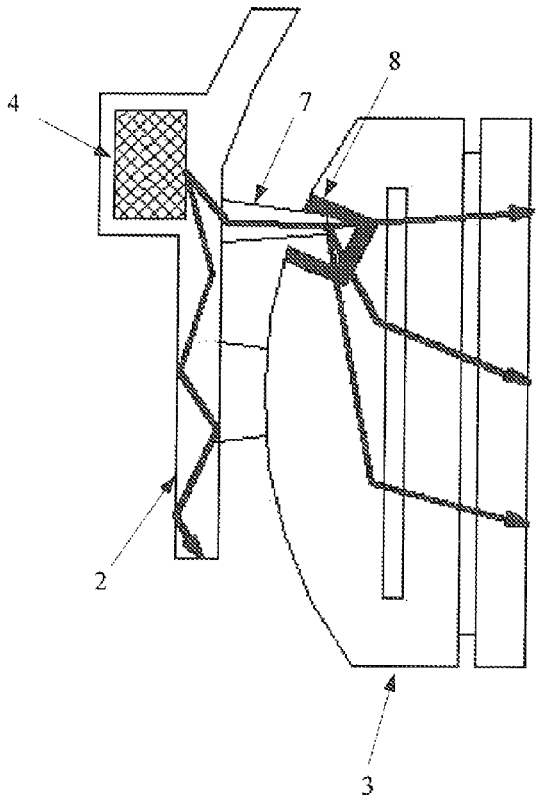
FIG. 3 is a schematic diagram showing transmission route of vibration on the sectional diagram of FIG. 2.

FIG. 2 is a sectional diagram of part of the earphone shown in FIG. 1. FIG. 3 is a schematic diagram showing transmission route of vibration on the sectional diagram of FIG. 2.

As shown in FIGS. 1-3, each of the vibration guiding columns 7 extends into the corresponding speaker chamber 3, and the distal end of each of the vibration guiding columns 7 is in contact with the inner wall of the corresponding speaker chamber 3. In this embodiment, the headset also comprises two vibration gum covers 8. The distal end of each of the vibration guiding columns 7 is in contact with the inner wall of the corresponding speaker chamber 3 via the corresponding vibration gum cover 8. The function of the vibration gum covers 8 is to increase the contact area between the vibration guiding columns 7 and the speaker chambers 3 for a better vibration transmission. This is because if the vibration gum cover 8 is absent, there will be only one small contact surface between the vibration guiding column 7 and the speaker chamber 3, and if the vibration gum cover 8 is added, there will be a greater contact surface owing to the soft texture of it.

In this way, the vibration produced by the vibratile terminal is transmitted to the speaker chamber 3 through the vibration guiding column 7 and the vibration gum cover 8, which makes the user's ears feel the vibration. The transmission route along which the vibration is transmitted by the vibration guiding column 7 is shown by the black polyline arrows in FIG. 3. If there is no vibration guiding column 7, the vibration will be transmitted downwards along the speaker shells, which has no obvious effect on the user's ears.

Therefore, the structure of this invention can transmit the vibration produced by the vibratile terminals to the user's head through the headband, and to the user's ears through the vibration guiding columns, which results in the homogeneous transmission of the vibration to the whole earphone.

Users will have better experiences with the use of the earphone of the present invention. For example, when the user is listening to music by using the earphone of this invention, the earphone will vibrate when outputting bass notes, so the user feels the vibration when appreciating the music, and the earphone of this invention can bring a stronger sense of shock than common earphone. And while the user is playing an electronic game by using the earphone of this invention, he can hear the footsteps of enemies when they are coming from behind. The earphone will vibrate when the user is shooting or attacked by the enemies, which provides the user a strong sense of shock.

Figure 4:
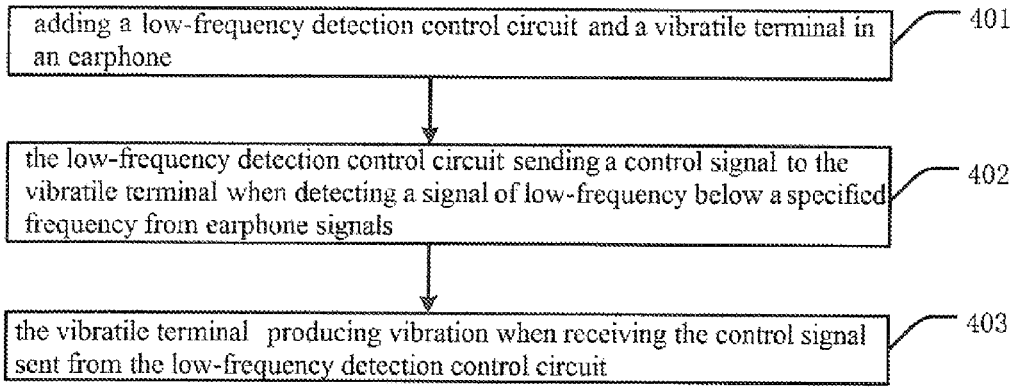
FIG. 4 is a flowchart of an implementation method of vibratile earphone in the present invention.

FIG. 4 is a flowchart of an implementation method of vibratile earphone in the present invention. As shown in FIG. 4, this method comprises the following steps:

401, adding a low-frequency detection control circuit and a vibratile terminal into the earphone.

In this step, adding a low-frequency detection control circuit into each of the two of left, and right speaker chambers of a headset, wherein the headset comprises a headband, two speaker shells and two speaker chambers, the two speaker shells are connected with the two ends of the headband respectively, and the two speaker chambers are fixed on the two speaker shells respectively; and fixing two vibratile terminals on the parts, close to the headband, of the two speaker shells respectively, such that the vibration of the two vibratile terminals causes the headband and the two speaker shells to vibrate.

Alternatively, in this step, the low-frequency detection control circuit and the vibratile terminal may also be provided in ear-plug earphone. In this case, the low-frequency detection control circuit and the vibratile terminal are all in the earphone shell.

402, the low-frequency detection control circuit sends a control signal to the vibratile terminal when detecting a signal of low-frequency below a specified frequency from earphone signals.

403, the vibratile terminal produces vibration when receiving the control signal sent from the low-frequency detection control circuit.

The method shown in FIG. 4 may further comprise: providing a vibration guiding column on each of the two speaker shells of the headset for transmitting the vibration produced by the vibratile terminals to the corresponding speaker chamber; extending each of the vibration guiding columns into the corresponding speaker chamber, such that the distal end of each of the vibration guiding columns is in contact with the inner wall of the corresponding speaker chamber. So the vibration produced by the vibratile terminals can be transmitted to the speaker chambers.

The method shown in FIG. 4 may further comprise: providing a vibration gum cover between the corresponding vibration guiding column and speaker chamber, such that the vibration guiding column is in contact with the corresponding speaker chamber via the vibration gum cover. In this way, the contact area between the vibration guiding columns and the speaker chambers can be increased for a better vibration transmission.

To sum up, the earphone of this invention comprises: a low-frequency detection control circuit and a vibratile terminal connected to the low-frequency detection control circuit, wherein the low-frequency detection control circuit sends a control signal to the vibratile terminal when detecting a signal of low-frequency below a specified frequency from earphone signals, and the vibratile terminal produces vibration when receiving the control signal sent from the low-frequency detection control circuit. This technical solution makes the earphone produce vibration when sound signals contain low-frequency parts, which improves people's sense of shock when they are listening to music or playing electronic games with the earphone. In addition, the vibration can be transmitted to the user's head through the headband, and to the user's ears through the vibration guiding columns, which results in the homogeneous transmission of the vibration to the whole earphone.

The foregoing description merely illustrates preferred embodiments of the present invention, and is not intended to limit the protection scope of the present invention. Any modification, equivalent replacement and improvement within the spirit and principle of the present invention should fall into the protection scope of the present invention.

The invention claimed is:

1. An earphone, the earphone is as headset, comprises: a headband, two speaker shells and two speaker chambers; wherein the two speaker shells are connected with the two ends of the headband respectively, and the two speaker chambers are fixed on the two speaker shells respectively; characterized in that the headset further comprises:

a low-frequency detection control circuit and a vibratile terminal connected to the low-frequency detection control circuit; two low-frequency detection control circuits correspond to two vibratile terminals respectively;

each of the two speaker shells is provided with a vibration guiding column for transmitting the vibration produced by the vibratile terminal to the corresponding speaker chamber;

each of the vibration guiding columns extends into the corresponding speaker chamber, and the distal end of each of the vibration guiding columns is in contact with the inner wall of the corresponding speaker chamber;

the low-frequency detection control circuit is for sending a control signal to the vibratile terminal when detecting a signal of low-frequency below a specified frequency from earphone signals;

the vibratile terminal produces vibration when receiving the control signal sent from the low-frequency detection control circuit; and the two vibratile terminals are fixed on the parts, close to the headband, of the two speaker shells respectively, and the vibration of the two vibratile terminals causes the headband and the two speaker shells to vibrate.

2. The earphone according to claim 1, characterized in that, the two low-frequency detection control circuits are in the two speaker chambers respectively.

3. The earphone according to claim 1, characterized in further comprising: two vibration gum covers, which correspond to the two vibration guiding columns on the two speaker shells respectively;

the distal end of each of the vibration guiding columns is in contact with the inner wall of the corresponding speaker chamber via the corresponding vibration gum cover.

4. An implementation method of vibratile earphone, the earphone is a headset, comprises: a headband, two speaker shells and two speaker chambers; wherein the two speaker shells are connected with the two ends of the headband respectively, and the two speaker chambers are fixed on the two speaker shells respectively; characterized in comprising the following steps:

adding a low-frequency detection control circuit into each of the two of left and right speaker chambers of a headset; fixing two vibratile terminals on the parts, close to the headband, of the two speaker shells of the headset respectively;

providing a vibration guiding column on each of the two speaker shells of the headset for transmitting the vibration produced by the vibratile terminals to the corresponding speaker chambers;

extending each of the vibration guiding columns into the corresponding speaker chamber, such that the distal end of each of the vibration guiding columns is in contact with the inner wall of the corresponding speaker chamber;

the low-frequency detection control circuit sending a control signal to the vibratile terminal when detecting a signal of low-frequency below a specified frequency from earphone signals; and the vibratile terminal producing vibration when receiving the control signal sent from the low-frequency detection control circuit, and the vibration of the two vibratile terminals causes the headband and the two speaker shells to vibrate.

5. The method according to claim 4, characterized in further comprising:

providing a vibration gum cover between the corresponding vibration guiding column and speaker chamber, such that the vibration guiding column is in contact with the corresponding speaker chamber via the vibration gum cover.

* * * * *